United States Patent [19]

Weidmann

[11] 4,002,356

[45] Jan. 11, 1977

[54] FOLDABLE CHECKBOOK WITH PEGBOARD STYLE JOURNAL SHEETS

[76] Inventor: Raymond C. Weidmann, 326 Palmyra Road, Macedon, N.Y. 14502

[22] Filed: Aug. 11, 1975

[21] Appl. No.: 603,721

[52] U.S. Cl. ..... 282/29 B; 282/8 R; 282/DIG. 1

[51] Int. Cl.[2] ..... B41L 3/00

[58] Field of Search ..... 35/75; 282/8 R, 29 R, 282/29 A, 29 B, DIG. 1; 283/58

[56] References Cited

UNITED STATES PATENTS

| | | | |
|---|---|---|---|
| 1,025,744 | 5/1912 | Houghton | 282/29 B |
| 1,206,745 | 11/1916 | Winter | 283/58 X |
| 1,988,368 | 1/1935 | Ainsworth | 282/29 B X |
| 2,117,372 | 5/1938 | Smith | 282/DIG. 1 X |
| 2,598,358 | 5/1952 | Connor | 282/29 B |
| 3,141,684 | 7/1964 | Haber | 282/29 R X |
| 3,142,496 | 7/1964 | Rideout | 282/29 A X |
| 3,278,200 | 10/1966 | Scully | 282/8 R |
| 3,722,922 | 3/1973 | Perez | 282/29 B |

*Primary Examiner*—Harland S. Skogquist
*Attorney, Agent, or Firm*—Shlesinger, Fitzsimmons & Shlesinger

[57] ABSTRACT

The checkbook comprises a flexible, foldable cover having a series of spaced pins along one edge to which a journal sheet is releasably attachable by inserting spaced openings in the edge of the sheet over the pins. Data is recordable in a plurality of horizontal rows of data boxes or spaces, which are printed on the face of the journal sheet, by placing a check over the sheet so that a row of data boxes on the check register vertically with a selected row of data boxes on the face of the journal sheet. Each check also has openings along one edge insertable over the pins on the cover releasably to hold the check in a desired position on the journal sheet. A strip of carbon backing on the back of each check registers with the data boxes on the face of the check and overlies the corresponding boxes on the journal sheet so that data entered on the check face is entered simultaneously on the journal. Two alternative means for securing the journal sheets and checks on the cover are also disclosed.

10 Claims, 7 Drawing Figures

FOLDABLE CHECKBOOK WITH PEGBOARD STYLE JOURNAL SHEETS

This invention relates to checkbooks, and more particularly to a foldable, breast-pocket-size checkbook having special checks and deposit slips, and pegboard style journal sheets which simplify record keeping.

Most conventional checkbooks include a plurality of removable, tear-out checks, and a corresponding number of stubs or record-keeping tabs, which remain bound in the checkbook after the checks have been removed. The disadvantage of this type of checkbook is that each of the stubs provides minimal recordkeeping spaces, for example sufficient only to enter the check number, the date written, the payee, the purpose (briefly) and the amount. Particularly in the case of checkbooks which are used principally for business purposes, the data on the check stubs must at some future date be transferred to a permanent record-keeping ledger or journal sheet.

It is an object of this invention to provide an improved checkbook, which contains record-keeping means which will simplify the transfer of data from the checkbook to a permanent record-keeping system.

Another object of this invention is to provide an improved, portable, breast-pocket-size checkbook having novel check and record-keeping means which are particularly compatible with permanent record-keeping ledgers, and the like.

A further object of this invention provides a checkbook of the type described which obviates the need for duplicating check record entries, once in a checkbook and later in a permanent ledger.

It is an object of this invention also to provide a novel checkbook having means for releasably securing checks on a journal sheet which is removable for transfer to a permanent record-keeping systems.

These and other objects of the invention have been achieved by providing a personal size checkbook which can be used for more purposes than the normal checkbook. For example, this novel checkbook is designed to provide the checkwriter with a permanent copy of all of the vital information of each check written. It is designed also to record the amounts spent in columnar form, so that the sum of the amounts spent for each of various purposes can be readily obtained at the end of any desired time interval. When the checkbook is folded up it can easily be carried in a man's pocket or a woman's pocketbook. It is as thin as most of the presently available checkbooks and thinner than some. Moreover, each check, although embodying some novel features, is otherwise of the same standard design as those presently available, and is therefore economically feasible.

Figure 1:
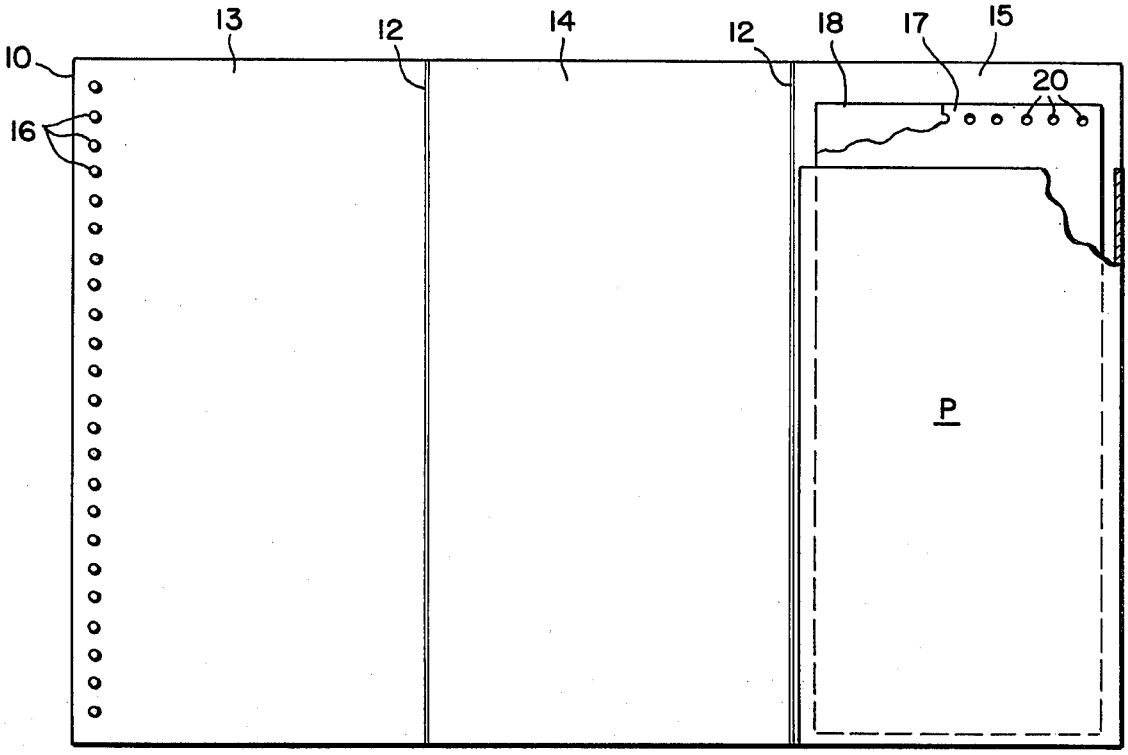
FIG. 1 is a plan view of the jacket or cover for a checkbook made according to one embodiment of this invention, a portion of the jacket and the check shown therein being cut away for purposes of illustration.

Referring now to the drawings by numerals of reference, and first to FIGS. 1 to 4, 10 denotes a rectangular, flexible checkbook jacket or cover intermediate its ends a pair of spaced, parallel seams 12 which divide the jacket into three separate sections 13, 14 and 15 that are foldable one over the other as noted hereinafter. The cover 10 may be made from a relatively tough, flexible plastic material which will form a resilient writing surface for a journal sheet or overlay, as noted hereinafter. Adjacent its left hand margin (FIG. 1) the cover is provided with a plurality of small, closely spaced, upstanding plastic or metal pegs or pins 16, which extend in a line between the upper and lower edges of the cover, and parallel to its adjacent end edge. A pocket is formed on the face of the cover 10 at its opposite end by a panel P of flexible material, which is secured along its sides and bottom edge to the corresponding sides and bottom edge of section 15 of the cover. Panel P, which may be made of the same material as the cover 10, extends only part way toward the upper edge of the cover so that the pocket formed thereby is easily accessible.

Figure 2:
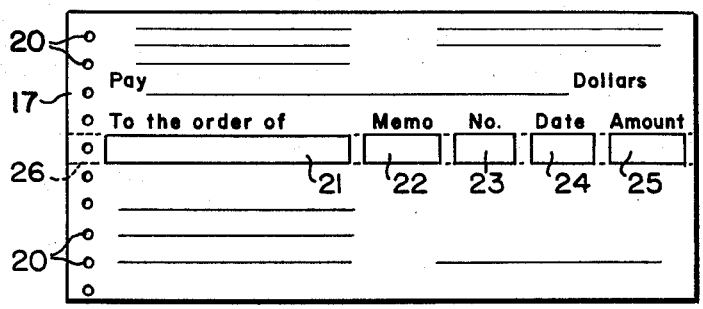
FIG. 2 is a plan view of the type of check which is adapted to be employed with this checkbook.
Figure 3:
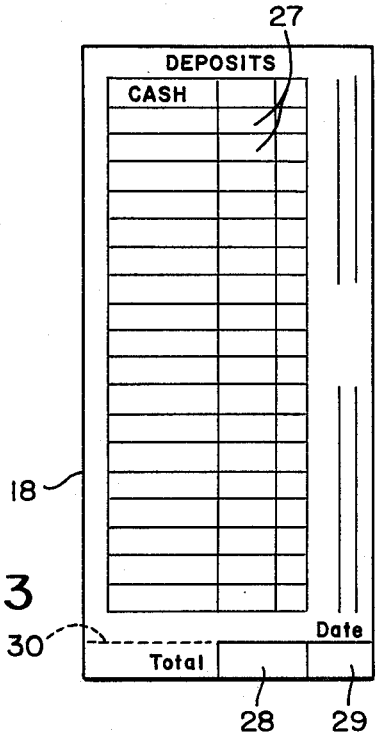
FIG. 3 is a plan view of the type of deposit slip which is adapted to be employed with this checkbook.

The pocket formed by panel P is adapted to contain a plurality of checks 17 and deposit slips 18, samples of which are illustrated in FIGS. 2 and 3, respectively. In one end, its left end as shown in FIG. 2, each check 17 has therein a plurality of spaced openings 20 which are adapted, as noted hereinafter, to register with the pins 16 on the checkbook cover 10. On its face, and beneath the line for entering the amount of the check, each check 17 has thereon five different boxes or separate spaces 21, 22, 23, 24 and 25 in which additional data may be entered. These data boxes or spaces are aligned with each other longitudinally of the check, and register with a strip 26 of carbon backing, which extends in a straight line completely across the back of the check intermediate its upper and lower edges.

Each deposit slip 18 has on its face a plurality of vertical columns 27 in which one or more bank deposits can be recorded and then totaled in a data box or space 28, which is located at the bottom of the column 27 along the lower edge of the deposit slip. Adjacent the box or space 28 is a further box 29 in which, for example, the date of the deposit can be entered. The side-by-side data boxes 28 and 29 on each deposit slip 18 register with a strip of carbon backing 30, which, as in the case of the strip 26, extends along the back of each deposit slip at least to register with the areas 28 and 29 thereon.

Figure 4:
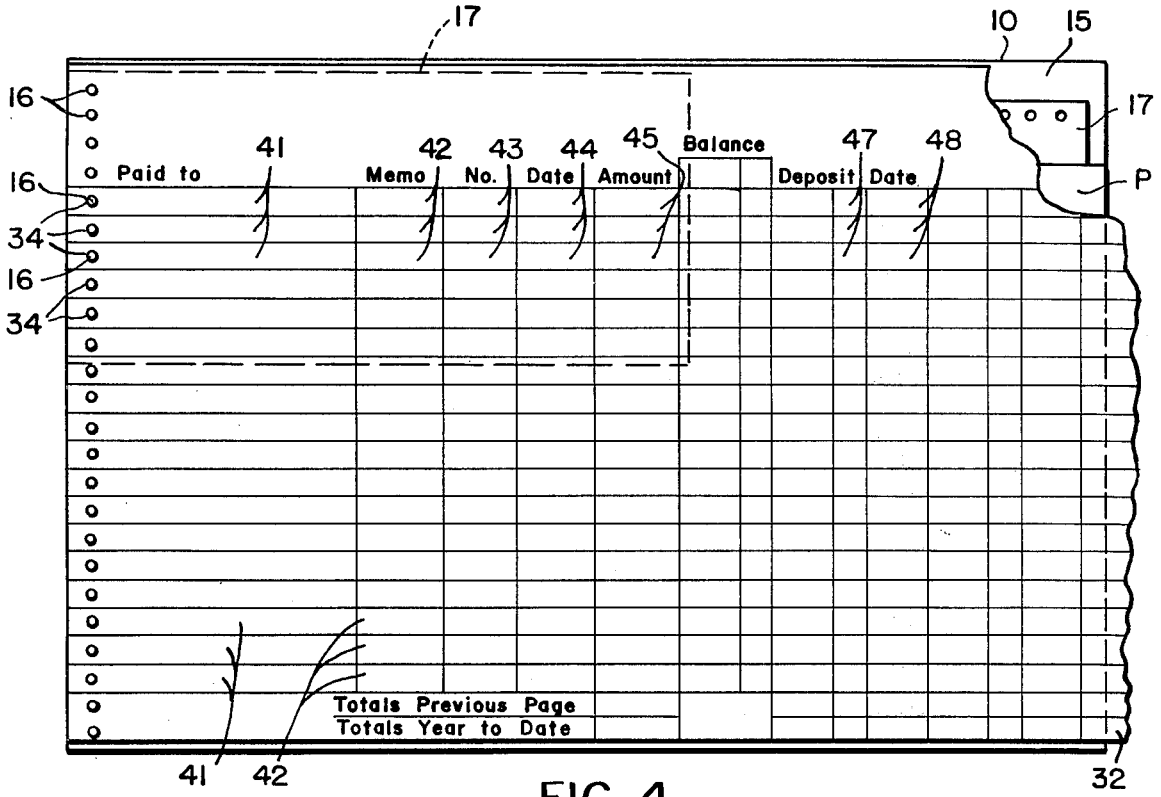
FIG. 4 is a fragmentary plan view of one type of journal sheet which is adapted to be employed with this checkbook, the sheet being shown as it appears when it is releasably attached to pegboard-type pins which form part of the associated checkbook.

Referring now to FIG. 4, 32 denotes one form of journal sheet which can be used with the checkbook shown in FIG. 1. Each sheet 32 is similar in configuration to the checkbook cover 10, although as shown in FIG. 4 it may be somewhat longer than the cover, if desired. Adjacent its left hand edge (FIG. 4) sheet 32 has therein a plurality of vertically spaced openings 34, which are disposed to register with, and to fit snugly over the pins 16 on cover 10, so that the pins may hold at least one journal sheet 32 at a time in a predetermined position on the cover.

The face of each sheet 32 is divided into a plurality of data spaces or boxed which are arranged in horizontal rows and vertical columns. A first group of data boxes are denoted at 41 in FIG. 4, and are arranged one beneath the other in a column which is headed "PAID TO". Next to this column is a group of data spaces or boxes 42, which are arranged one beneath the other in a column headed "MEMO". Similarly, additional groups of data boxes 43, 44 and 45 are formed on the face of the sheet 32 in columns headed "NO.," "DATE," and "Amt," respectively. Each journal sheet 32 is designed so the date boxes 41, 42, 43, 44 and 45 of each successive horizontal row thereof will register, respectively, with the data boxes 21, 22, 23, 24 and 25, respectively, of a check 17, when the check is secured by its openings 20 over the pegs 16 on the cover 10, as shown by the check 17 which is shown in phantom by the broken lines in FIG. 4.

For example, when it is desired to write a check 17, and assuming that a new or blank journal sheet 31 has been placed on the pegs 16 as shown in FIG. 4, the writer withdraws a check 17 from the pocket beneath panel P, and places its openings 20 over the uppermost series of pins 16 on the cover 10. As shown by comparison of check 17 in FIG. 2 with the check 17 shown in phantom in FIG. 4, this causes the fourth in 16 down from the top of the cover 10 to enter the fourth opening 20 down from the upper edge of the check 17. In the embodiment illustrated, this particular opening 20 in the check registers with the line of data boxes 21 to 25 on the check, so that these data boxes will therefore overly and register with the corresponding boxes 41, 42, 43, 44 and 45, respectively, in the first row thereof on sheet 32. Therefore, when the check writer enters on the check in block or box 21 the name of the payee, the carbon backing 26 on the check will cause this name to be entered simultaneously in the uppermost box 41 on the journal sheet 32. Similarly, as the writer enters in boxes 22, 23, 24 and 25 of the check the purpose, number, date and amount of the check, this data will be simultaneously entered in the uppermost of the boxes 42, 43, 44 and 45 on sheet 32.

When the writer writes the next check, he or she will place its openings 20 on the pins 16 so that the carbon strip 26 on the back of this next check will register with the second row of boxes 41 to 45 on sheet 32, so that the data concerning the second check will be entered simultaneously on the check and in the proper data boxes on the journal sheet 32. Obviously, as each successive check 17 is written or made out, it will first be placed on the pins 16 so that its carbon backing strip 26 will register with the proper row of empty data boxes 41 to 45 on the journal sheet 32.

Whenever the owner of the checkbook makes a deposit, the deposit slip 18 need only be positioned so that its carbon backing strip 30 registers with a side-by-side pair of data boxes 47 and 48, which are arranged in side-by-side columns on the face of each journal sheet 32 beneath the headings "DEPOSIT" and DATE, respectively. The total amount of each deposit and the date upon which the deposit is made are thus simultanesouly entered both on the deposit slip 18 and on the appropriate part of the journal sheet 32.

Whenever a journal sheet 32 is filled, or at any interval that the check writer wishes, for example at monthly intervals or the like, the journal sheet 32 can be withdrawn from the cover 10 and placed in a permanent pegboard-type ledger book. A new, blank sheet 32 is then secured in the cover 10, in the manner noted above, to provide a new record for subsequent checks and deposits. In addition to the above-noted data spaces or boxes 41 to 45, 47 and 48 it is apparent that each journal sheet 32 might include other columns and rows of data boxes or spaces for entering other information such as balances, etc.

To close the checkbook the journal sheet 32 may be folded on itself as desired, and sections 15 and 14 of cover 10 can be folded one over the other against section 13 so that the folded cover can be carried in one's breastpocket, purse, or the like.

Figure 5:
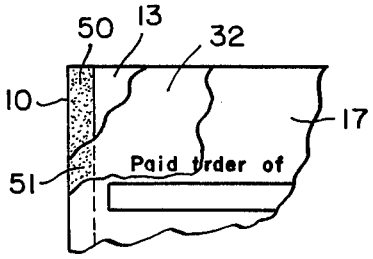
FIG. 5 is a fragmentary plan view of a modified checkbook, journal sheet and check assembly broken away in part to illustrate still another way of releasably attaching these members together.

Instead of using pins 16 and cooperating openings 20 and 32 in the checks and journal sheets, respectively, the left-hand edge of cover 10 may have thereon instead of pins 16 a strip 50 (FIG. 5) of pressure-sensitive adhesive to which the back of a journal sheet 32 may be releasably adhered as shown fragmentarily in FIG. 5. In such case each journal sheet 32 may also have on its face along its left margin a similar strip 51 of adhesive to which the checks 17 may be releasably adhered while they are being filled out. Alternatively, of course, the left-hand edge of the jacket 10 may be made to accept a temporarily sensitized adhesive strip which can be formed on the back of the journal sheet 32 along the left-hand edge thereof; and each check 17 may have on the back thereof a similar strip of temporarily sensitized adhesive along its left-hand edge for releasably securing it to the journal sheet 32.

Figure 6:
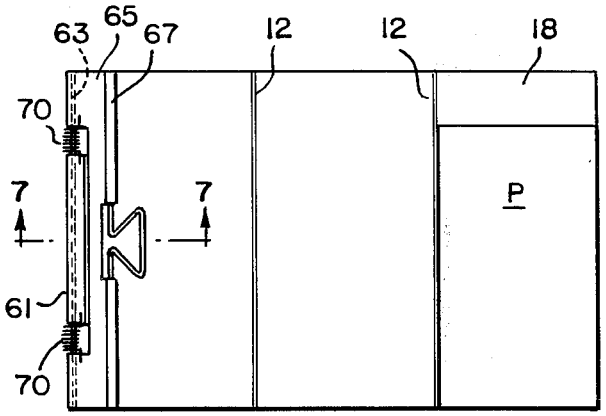
FIG. 6 is a plan view of this checkbook with the ledger sheet releasably attached thereto by clamping means which forms still another embodiment of this invention.
Figure 7:
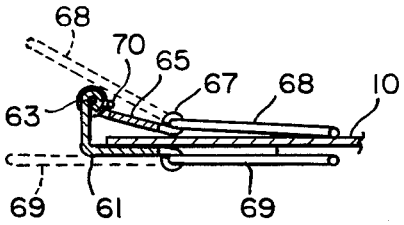
FIG. 7 is an enlarged fragmentary sectional view taken along the line 7—7 in FIG. 6 looking in the direction of the arrows.

FIGS. 6 and 7 illustrate still a different means for securing checks and journal sheets releasably to the cover 10. In this embodiment an elongate, right-angular metal plate 61 has one leg thereof secured to cover 10 along the side thereof remote from the panel P, and has its other leg projecting upwardly and pivotally connected by a pin 63 to one edge of a clamping plate 65. Along its opposite edge plate 65 has a rolled lip 67 disposed to overly the cover 10. A pair of handles 68 and 69 are pivotally connected, respectively, to the underside of plate 61, and to the rolled edge of clamping plate 65, and are pivotal into operative, broken line position as shown in FIG. 7. When the handles are in these positions, they can be squeezed toward one another to pivot the clamping plate 65 upwardly from engagement with the surface of cover 10 against the resistance of torsion springs 70, which surround the pin 63 between plates 61 and 65. When the clamp 65 is in its upper or released position a journal sheet and/or a check may be inserted therebeneath on the face of cover 10. When not in use, the handles 68 and and 69 can be swung downwardly into the positions shown in FIG. 7, which enables the cover 10 to be folded up into breastpocket size.

From the foregoing it will be apparent that applicant has developed a very compact, efficient and time-saving checkbook, which is readily adaptable to known checkbook and bookkeeping systems. The design of the check 17 is very much standard in appearance, therefore it is readily usable. The completely standard design of the check face allows the writer the opportunity to use a window envelope to mail his check therefore eliminating a possible error of sending a check to the wrong payee. Other personal size checkbooks do not allow the use of a window envelope because they are either not standard in design or do not have appropriate places for the address of the payee.

The journal sheet 32 may provide for the reporting of as much as eighteen checks, but the journal sheet can be designed to provide even more than eighteen, and in virtually any design it would provide more than fifteen lines and because of this the summarization of columns is meaningful and useful. The journal sheet also records by carbon or chemical copy process the total amount of each deposit made and the date thereof. This copy process as to total deposit amounts eliminates the possibility of any error with respect to the data necessary to determine the checkbook balance. The journal may provide at least 19 distribution columns for the recording of checks according to purpose or type of expense. Some of these nineteen columns may also be used to record the sources of funds included in each deposit. The bottom of the journal is designed to provide for the accumulation of data during any particular period of time, even when that period of time requires the use of more than one journal page. The journal sheet when concluded fits inside a standard letter size folder therefore facilitating the accumulation of data for a long period of time in a reasonable size file or booklet.

The checks for each journal are provided in a separate booklet in order to allow the check writer the opportunity to begin a new journal page even though the previous page may not be completely filled. This design feature allows the check writer to begin a new journal page at the beginning of various chronological periods. In most other personal size checkbooks the check record cannot be conveniently stopped at the end of a chronological period of choice.

In its current configuration the checkbook is designed to be attached to a standard size money and credit card wallet. The surface below the journal sheet is made of a resilient material in order to provide an appropriate writing surface, and in contrast, other checkbooks which provide for the carbonization of check information use a metal surface which does not lend itself to the carbonizing process. The resilient surface also provides sufficient form and firmness so that the check writer does not necessarily need a desk or similar surface on which to place his checkbook.

The jacket, journal, and individual check may be brought into proper aligning position and held in that position by any of the three above-described methods.

This particular system provides the check writer with all the advantages available in a commonly available checkbook and accounting system which is commonly known among businessmen and certain professionals in the United States as pegboard. This pegboard system is quite thoroughly explained in U.S. Pat. No. 1,025,744 dated May 7, 1912. However all such available pegboards when completely folded and prepared for storage or carrying are at least larger than eight and one-half by eleven inches. Specifically, none of these pegboard systems fit in the common size pockets of men's clothing nor do they fit in women's purses. This particular system provides all of the record-keeping advantages of pegboard in a pocket ize configuration. It can be used by businessmen and nonbusinessmen alike. It eliminates virtually all of the errors that can be made by a check writer in the use of a common personal checkbook.

The manner of folding the journal sheet both facilitates a somewhat more compact size when the checkbook is open for use and also provides the writer with the opportunity of maintaining his bank balance in total confidentiality because the bank balance column is covered by the last folded section of the journal sheet.

While this system has been described in connection with checkbooks in which the releasable fastening means are arranged along the left end of the cover 10, it will be apparent that the means could be placed along the right end of cover 10 to suit left-handed writers. Moreover, although only certain embodiments of this invention have been illustrated and described herein, it will be apparent that it is capable of further modification, and this application is intended to cover any such modifications which fall within the scope of one skilled in the art or the appended claims.

Having thus described my invention, what I claim is:

1. A checkbook, comprising a flexible cover, means for storing a plurality of checks in said cover, each of said checks having on its face a row of data spaces and on its back a strip of carbon which registers with said row of data spaces, a journal sheet releasably attached to said cover to overlie one side thereof and having on its face a plurality of data spaces arranged in intersecting horizontal rows and vertical columns, and means for releasably securing said checks on said journal sheet in different operative positions in which the carbon strip on the back of each check registers with a different horizontal row of data spaces on said sheet, and overlies at least certain of the data spaces in the last-named row, each of said checks having the data spaces on the face thereof arranged so that, when the check is secured in an operative position on said sheet, the data spaces on the check will register with said certain spaces on the sheet which are covered by the check's carbon strip, whereby data entered in said spaces on the face of said check will be entered simultaneously by said carbon strip onto the journal sheet spaces covered thereby.

2. A checkbook as defined in claim 1, wherein said securing means comprises a plurality of spaced pins projecting from said one side of said cover adjacent one edge thereof, and each of said checks has along one edge thereof a plurality of openings which are insertable snugly over at least certain of said pins releasably to secure the check in an operative position on said sheet.

3. A checkbook as defined in claim 2, wherein said journal sheet has along one edge thereof a plurality of spaced openings insertable snugly over said pins releasably to attach said sheet to said cover, and said cover and said sheet being foldable into closed positions in which said sheet is enclosed in said cover, and said cover assumes a generally breast-pocket size configuration.

4. A checkbook as defined in claim 1, wherein said securing means comprises a first strip of adhesive on one of the confronting surfaces of said cover and said journal sheet, respectively, releasably to attach said sheet to said cover, and a second strip of adhesive on one of the confronting surfaces of said journal sheet and the check which is secured thereon, respectively, and operative releasably to hold the check in an operative position on said sheet.

5. A checkbook as defined in claim 1, wherein said securing means comprises a first member secured to and extending along one edge of said cover, a clamping member pivotally attached to said first member and having an elongate clamping edge pivotal toward said one side of said cover to a clamping position in which it clamps said sheet and a check one above the other in operative positions on said cover, resilient means interposed between said members and urging said clamping member into its clamping position, and means for pivoting said clamping member manually away from said one side of said cover thereby selectively to release said sheet and the last-named check.

6. A checkbook as defined in claim 5, wherein said means for pivoting said clamping member comprises a pair of handles pivotally connected to said members for swinging movement relative to said members between inoperative positions in which the handles are folded against opposite sides of said cover and parallel to the plane thereof, and operative positions in which one of the handles may be swung manually toward the other to pivot said clamping member to its released position.

7. A checkbook as defined in claim 1, including a plurality of deposit slips adapted to be stored with said checks in said cover, each of said slips having on its face a plurality of data spaces adjacent one end thereof, and having on its rear surface a strip of carbon registering with the last-named data spaces, said deposit slips being placeable manually and selectively in operative positions on said sheet, and each of said rows of data spaces on said journal sheet including, in addition to said certain spaces, further spaces which are registrable with said carbon strip on one of said deposit slips when the last-named slip is placed in an operative position on said journal sheet.

8. a checkbook as defined in claim 1, wherein said cover has intermediate its ends at least one fold line which divides the cover into a plurality of sections foldable one over the other to close the cover to a size in which it is suitable for carrying in a breast-pocket and the like, said journal sheet is foldable with said cover to a closed position in which it remains attached to, and folded within, said cover, and said means for storing checks comprises a flexible panel extending over a portion of one of said cover sections to form thereon a pocket for holding a stack of said checks.

9. A foldable checkbook, comprising, in combination, a plane, flexible cover having intermediate its ends at least one fold line extending parallel to one edge of the cover, and dividing the cover into a plurality of sections which are foldable one over the other when the cover is closed, a journal sheet releasably secured on one side of said cover with one edge thereof registering with said one edge of said cover, and having on its face a plurality of data spaces arranged in intersecting horizontal rows and vertical columns, a plurality of checks each having on the back thereof a strip of carbon and on the face therof a row of data spaces which registers with said strip, the height of said row of data spaces on each of said checks being substantially equal to the height of a row of said data spaces on said sheet, and means for releasably securing said checks one-by-one on top of said journal sheet with one edge of the check registering with said one edge of said cover, respectively, and with said row of data spaces on said check extending parallel to said rows of data spaces on said sheet, and with the data spaces on said check registering with at least certain of the data spaces in one of said rows thereof on said sheet, said check securing means being operable to secure said checks one after the other on the face of said sheet in different operative positions in which the row of data spaces on successive checks register with successive rows of data spaces on said journal sheet.

10. A foldable checkbook a defined in claim 9, wherein said securing means comprises a plurality of spaced pins projecting from said one side of said cover adjacent said one edge thereof and through registering openings in said one edge of said journal sheet releasably to hold said sheet on said cover, and each of said checks having therein a plurality of spaced openings arranged along said one edge thereof and insertable over said pins releasably to be held thereby on said sheet, and selectively in said different operative positions.

* * * * *